US007891712B2

(12) United States Patent
Herelier

(10) Patent No.: US 7,891,712 B2
(45) Date of Patent: Feb. 22, 2011

(54) SEALING CONNECTOR AND ASSEMBLY

(75) Inventor: Patrick Herelier, Saint Jean de Muzols (FR)

(73) Assignee: Societe de Prospection Et d'Inventions Techniques Spit, Bourg les Valence (FR)

( * ) Notice: Subject to any disclaimer, the term of this patent is extended or adjusted under 35 U.S.C. 154(b) by 637 days.

(21) Appl. No.: 11/910,066

(22) PCT Filed: Apr. 25, 2006

(86) PCT No.: PCT/IB2006/001012

§ 371 (c)(1),
(2), (4) Date: Sep. 28, 2007

(87) PCT Pub. No.: WO2006/114693

PCT Pub. Date: Nov. 2, 2006

(65) Prior Publication Data

US 2009/0041537 A1 Feb. 12, 2009

(30) Foreign Application Priority Data

Apr. 26, 2005 (FR) ..... 0504157

(51) Int. Cl.
*F16L 21/02* (2006.01)

(52) U.S. Cl. ..... 285/369; 285/331; 285/374; 285/417; 277/608

(58) Field of Classification Search ..... 277/637, 277/638, 607, 608, 611, 614, 651, 654, 616, 277/652; 285/331, 286.1, 394, 215, 216, 285/369, 399, 417, 374; 227/9, 10; 141/351–357, 141/360–375

See application file for complete search history.

(56) References Cited

U.S. PATENT DOCUMENTS

| | | | |
|---|---|---|---|
| 925,959 | A | 6/1909 | Smith |
| 1,213,518 | A | 1/1917 | McEwen |
| 2,015,786 | A | 10/1935 | Carcano |

(Continued)

FOREIGN PATENT DOCUMENTS

| | | | |
|---|---|---|---|
| DE | 1848935 | U | 3/1962 |
| DE | 7128003 | U | 8/1972 |
| DE | 2136448 | A1 | 2/1973 |
| DE | 2611233 | A1 | 9/1977 |

(Continued)

OTHER PUBLICATIONS

Office Action for corresponding MXP200750065 mailed Feb. 12, 2010.

International Search Report for PCT/IB2006/001012 mailed Sep. 27, 2006.

*Primary Examiner*—James M Hewitt
*Assistant Examiner*—Jay R Ripley
(74) *Attorney, Agent, or Firm*—Lowe, Hauptman, Ham & Berner, LLP (ITW)

(57) ABSTRACT

The sealing connector ensures sealing between a gas cartridge having an outlet fitting and a transmission member for filling a combustion chamber of a gas fastening device having an inlet fitting with gas and includes two internal sealing sleeves for receiving the two fittings, at least one of which is made of flexible material, with, at the bottom of this sleeve, a flexible transverse annular partition for dimensional adjustment, and an external slide. A rigid transverse annular partition is provided at the bottom of the other of the two sleeves to serve as a support for a fitting.

2 Claims, 2 Drawing Sheets

U.S. PATENT DOCUMENTS 2,329,000 A 7/1940 Rembert
2,249,796 A * 7/1941 Thoms ..... 222/5
2,523,716 A 11/1946 Parr
2,661,964 A 12/1953 Mann
2,805,591 A 12/1955 Widmer
2,773,521 A 12/1956 Persson
3,186,042 A * 6/1965 Daley ..... 277/651
3,191,950 A * 6/1965 Hiltner ..... 277/611
3,216,140 A 11/1965 Termet
3,216,628 A 11/1965 Fergusson
3,266,533 A 8/1966 McHale
3,292,668 A 12/1966 Little
3,318,346 A 5/1967 Maltner
3,400,704 A 9/1968 Schlamp et al.
3,514,129 A 5/1970 Holdren
3,595,279 A 7/1971 Jaffe
3,608,538 A 9/1971 Guerrero
3,620,267 A 11/1971 Seablom
3,712,646 A 1/1973 Bergougnoux
3,817,297 A 6/1974 King
3,877,499 A 4/1975 Fluster
3,883,062 A 5/1975 Jochum
3,884,256 A 5/1975 Corlet
3,907,012 A 9/1975 Burke
3,945,617 A 3/1976 Callery
3,977,575 A 8/1976 Macquire-Cooper
4,005,883 A 2/1977 Guest
4,123,091 A 10/1978 Cosentino et al.
4,305,528 A 12/1981 Craig
4,331,277 A 5/1982 Green
4,342,725 A 8/1982 Collins
4,436,125 A 3/1984 Blenkush
4,482,172 A 11/1984 DeVera et al.
4,483,474 A 11/1984 Nikolich et al.
4,484,769 A 11/1984 Lacey
4,613,112 A 9/1986 Phlipot et al.
4,619,297 A 10/1986 Kocher
4,625,780 A 12/1986 Burnham
4,657,286 A 4/1987 Guest
4,682,798 A 7/1987 Sauer
4,693,242 A 9/1987 Biard
4,717,060 A 1/1988 Cotta
4,739,915 A 4/1988 Cotta
4,803,053 A 2/1989 Williamson
4,902,043 A 2/1990 Zillig et al.
4,905,965 A 3/1990 Dolev
4,949,745 A 8/1990 McKeon
4,971,224 A 11/1990 Scremin
5,024,454 A * 6/1991 McGilp et al. ..... 277/616
5,035,345 A 7/1991 Janko et al.
5,070,858 A 12/1991 Wang
5,090,747 A 2/1992 Kotake
5,104,158 A 4/1992 Meyer et al.
5,115,944 A 5/1992 Nikolich
5,125,848 A 6/1992 Zimmerly
5,127,436 A 7/1992 Campion et al.
5,213,913 A 5/1993 Anthony, III et al.
5,225,293 A 7/1993 Mitchell et al.
5,263,439 A 11/1993 Doherty et al.
5,328,216 A 7/1994 Miyauchi et al.
5,330,154 A 7/1994 Mashburn et al.
5,413,230 A 5/1995 Folter et al.
5,425,478 A 6/1995 Kotaki et al.
5,490,545 A 2/1996 Sokoloff et al.
5,494,074 A 2/1996 Ramacier, Jr. et al.
5,558,371 A 9/1996 Lordo
5,566,708 A 10/1996 Hobbs, Jr.
5,589,288 A 12/1996 Coulson et al.
5,642,763 A 7/1997 Kurtz
5,692,783 A 12/1997 Watanabe et al.
5,842,682 A 12/1998 Schennum et al.
5,851,036 A 12/1998 Vanesky
5,873,508 A 2/1999 MacVicar et al.
5,962,805 A 10/1999 Saxby
5,984,266 A 11/1999 Kotake
6,003,506 A 12/1999 Long et al.
6,071,639 A 6/2000 Bryant et al.
6,098,652 A 8/2000 Brandt
6,102,270 A 8/2000 Robinson
6,138,714 A 10/2000 Kim
6,168,881 B1 1/2001 Fischer et al.
6,217,085 B1 4/2001 Toulouse
6,223,966 B1 5/2001 Nayrac et al.
6,230,737 B1 5/2001 Notaro et al.
6,260,519 B1 7/2001 Phillips
6,422,267 B1 7/2002 Makishima et al.
6,457,899 B1 10/2002 Lin
6,467,515 B1 10/2002 Lin
6,523,860 B1 2/2003 Shkolnikov et al.
D481,425 S 10/2003 Schmitz, III
6,656,163 B1 12/2003 Marshall et al.
6,786,378 B2 9/2004 Wagdy et al.
6,827,329 B2 12/2004 Mikiya et al.
6,889,731 B2 5/2005 Vallon et al.
6,899,132 B2 5/2005 Mikiya et al.
6,901,962 B2 6/2005 Kroupa et al.
6,996,987 B2 2/2006 Gregory et al.
7,051,686 B2 5/2006 Shkolnikov et al.
7,090,260 B2 8/2006 Revol
7,222,765 B2 5/2007 Robinson
7,314,211 B2 1/2008 Vallon et al.
7,429,430 B2 9/2008 Mooty et al.
2003/0111135 A1 6/2003 Vallon et al.
2003/0111136 A1 6/2003 Vallon et al.
2004/0112309 A1 6/2004 Odoni et al.
2004/0206798 A1 10/2004 Robinson
2008/0190985 A1 8/2008 Almeras

FOREIGN PATENT DOCUMENTS

DE 9301532 U1 5/1993
DE 20201697 U1 5/2002
DE 20202886 U1 6/2002
EP 0471503 A2 2/1992
EP 0936031 A1 8/1999
EP 1197299 A 4/2002
EP 1310334 A1 5/2003
EP 1327501 A2 7/2003
EP 1468788 A 10/2004
ES 2115932 T3 7/1998
ES 2276242 T3 6/2007
ES 2282384 T3 10/2007
FR 48714 E 6/1938
FR 1468788 A 2/1967
FR 2558563 A1 7/1985
FR 2683295 A1 5/1993
FR 2833685 A 6/2003
FR 2845148 A1 4/2004
FR 2870920 A 12/2005
FR 2884749 A1 10/2006
GB 961038 A 6/1964
GB 1033689 A 6/1966
GB 1101918 A 2/1968
GB 1152890 A 5/1969
GB 2167147 A 5/1986
GB 2172356 A 9/1986
GB 2211506 A 7/1989
LU 48714 A 7/1965
WO 01/35015 A1 5/2001
WO 2006/114690 A1 11/2006
WO 2006114695 A2 11/2006

* cited by examiner

SEALING CONNECTOR AND ASSEMBLY

RELATED APPLICATIONS

The present application is based on International Application No. PCT/IB2006/001012 filed Apr. 25, 2006, and claims priority from French Application Number 0504157 filed Apr. 26, 2005, the disclosure of which is hereby incorporated by reference herein in its entirety.

BACKGROUND

The invention relates to sealing connectors in gas fastening devices, mounted between the gas cartridge and the solenoid valve for filling the combustion Chambers of these devices in order to ensure sealing of the duct extending through the outlet and filling fittings of the cartridge and the solenoid valve. The term "solenoid valve" is used here for the sake of simplicity, although it could also be a simple mechanical valve and, more generally, any other member for transmitting the gas from the cartridge towards the combustion chamber.

Possible fastening devices are, e.g. nail drivers for applications with wood.

The connectors in question, e.g. such as those described in French patent applications FR 0405605 and FR 0407208 not yet published at the time of filing this application, include a double internal sealing sleeve for receiving the two fittings made of a flexible material, with a generally central transverse annular partition for dimensional adjustment, and an external slide in which the double sleeve is mounted.

The slide ensures that the shape or morphology of the flexible double sleeve is maintained and allows the connector to slide in the adapter of the cartridge, by virtue of which, when the cartridge is removed from the device, the sleeve made of flexible material does not remain "stuck" against the adapter and does not hold the fitting of the cartridge in the gas exhaust position.

On the one hand, the fitting of the cartridge may pierce the central partition for dimensional adjustment made of flexible material and, on the other hand, this central partition may he deformed to such an extent that it will obstruct the duct for the passage of gas.

There is a need for a sealing connector made of one single material sufficiently flexible to ensure sealing between the two fittings, but sufficiently rigid to prevent the central partition from being damaged or deformed and blocking one of the fittings for the passage of gas.

SUMMARY

This application thus relates to a sealing connector for ensuring sealing between a gas cartridge having an outlet fitting and a transmission member for filling a combustion chamber of a gas fastening device having an inlet fitting with gas, including two internal sealing sleeves for receiving the two fittings, at least one of which is made of flexible material, with, at the bottom of this sleeve, a flexible transverse annular partition for dimensional adjustment, and an external slide, the connector being, characterised in that it is provided at the bottom of the other of the two sleeves with a rigid transverse annular partition to serve as a support for a fitting.

When the outlet fitting of the cartridge is engaged in the sleeve on the side of the rigid partition, there is no risk that it will pierce the flexible partition for dimensional adjustment, by virtue of the rigid partition inserted between it and the flexible partition and against which it bears.

In the preferred embodiment of the connector of the invention, the rigid partition is integral with the slide.

The two flexible and rigid partitions are advantageously contiguous.

In a first embodiment, the trio sleeves for receiving the two fittings are joined together to form a double internal sealing sleeve formed in one piece from flexible material.

In this case, it is advantageous that the double sleeve made of flexible material is an injection-moulded part and the rigid supporting partition is provided with orifices for the passage of the injection-moulded material of the double sleeve.

In a variant embodiment, the sleeve at the bottom of which the rigid transverse annular partition is situated forms one single piece made of rigid material with the external slide, the internal sleeve extending inside the external slide with play.

The invention also relates to an assembly consisting of a transmission member for filling the combustion chamber of a gas fastening device with gas, a gas cartridge, an adapter and, mounted in the adapter, a connector for providing sealing between the transmission member and the cartridge, the sealing connector being the connector of the invention.

BRIEF DESCRIPTION OF THE DRAWING

The invention will be more readily understood with the aid of the following description of the preferred embodiment of the connector of the invention and a variant. with reference to the accompanying drawings, in which.

DETAILED DESCRIPTION

Figure 1:
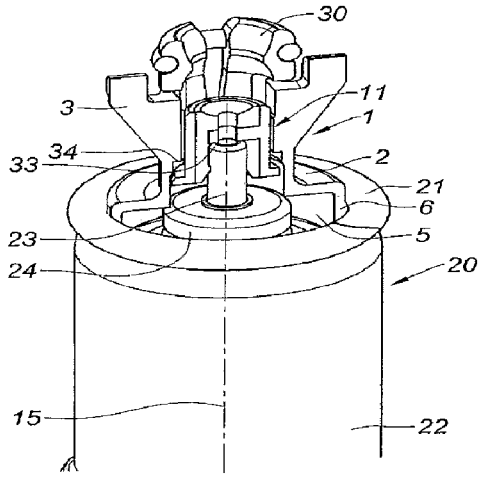
FIG. 1 is a perspective view of an assembly consisting of the solenoid valve of a fastening device, a gas cartridge and the connector of the invention.
Figure 2:
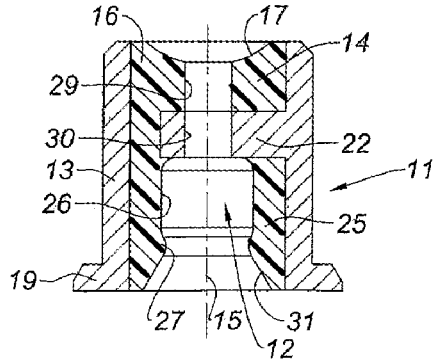
FIG. 2 is an axial section of the connector of the assembly of FIG. 1.
Figure 3:
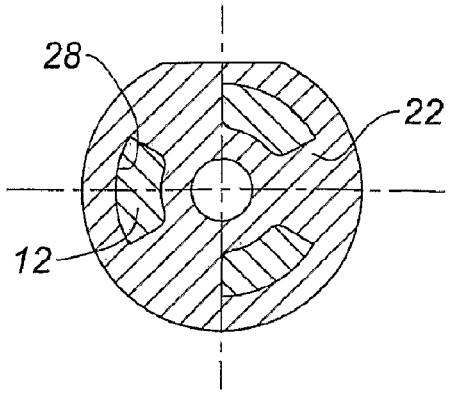
FIG. 3 is a transverse section of the connector of FIG. 2 along the line III-III.

The connector which will now be described with reference to FIGS. 1 to 3 is intended to ensure sealing between a propellant cartridge 20 and a transmission member which is a solenoid valve 30 for filling the combustion chamber of a gas fastening device. The reference numeral 30 does not in fact designate the solenoid valve itself in the drawings, but hooking legs for the adapter, which will be described hereinafter for connecting the solenoid valve and the cartridge.

A fastening device for fastenings fastening elements by means of a piston driven by compressed as comprises an internal combustion engine comprising a combustion chamber intended to be supplied with compressed gas from a gas cartridge 20 in order to drive the piston itself intended to drive the fastening elements.

In this particular example, a connecting adapter 1 intended to connect the solenoid valve 30 for the admission of the compressed gas into the combustion chamber of the fastening device and the compressed gas cartridge 20 is provided.

The cartridge 20 of generally cylindrical shape is provided in an internal casing with the compressed gas in the liquid state and between the internal casing and an external casing 22 with a propellant. A circular edge 21 forms a continuation of the external cylindrical wall of the cartridge 20, at one of the ends of the latter. A male outlet fitting 23 connected to the internal casing projects from the cartridge by means of a base 24 situated in the centre of the dish formed in the interior of the edge 21.

The solenoid valve 30 of generally cylindrical shape is provided at one of its ends with an inlet fitting connected in the interior of the solenoid valve to an outlet fitting (not shown). This is in reality not exactly the inlet fitting of the solenoid valve, but an intermediate inlet fitting. The inlet fitting is in this case a male fitting.

The adapter 1 serves as a support for the sealing connector 11 intended to receive the male oulet fitting 23 of the cartridge 20 and the male inlet fitting of the solenoid valve 30.

The adapter 1, in this case formed in one piece from plastic, includes a flat, in this case, circular supporting base 2 supporting the chamber 3 for housing the sealing connector 11 open at both ends and extending along an axis 15 perpendicular to the supporting base 2 on one side of the latter.

A cylindrical skirt 5 having an axis 15 is connected to the supporting base 2 perpendicularly to the supporting base 2 on the side opposite that of the chamber 3. The external diameter of the skirt 5 is substantially equal to the internal diameter of the edge 21 of the fuel cartridge 20. The skirt 5 is moreover provided with a circumferential rib forming a boss 6 intended to engage with the internal wall of the edge 21.

The sealing connector 11 includes an internal sealing component 12 and an external slide component 13. The internal sealing component 12 is in this case a double sleeve formed in one piece intended to receive two sides of the two make fittings 23, namely the outlet fitting 23 of the cartridge and the inlet fitting of the solenoid valve. The double sleeve 12 includes a transverse annular partition 14 for dimensional adjustment in fact disposed at the bottom of one of the two sleeves of the double sleeve, the latter 16 being intended to receive the inlet fitting of the solenoid valve. The partition 14 is designed as a dish 17 on the side of the opening of the sleeve 16 in order to receive a spherical hooking portion for the inlet fitting (intermediate fitting).

The double sleeve 12 with its partition 14 for dimensional adjustment is made of flexible material. e.g. a thermoplastic material which can be vulcanised and injected and, more generally, an injectable flexible polymer.

The external slide component is a slide 13 in which the double sleeve 12 extends without play, intended to hold the shape of the flexible double sleeve 12. The slide 13 has a generally tubular shape with, at one end, an external annular rim 19 for holding, it in the adapter 1, in cooperation with an internal annular shoulder 34 formed on the adapter. The slide 13 includes a transverse annular partition 22 in fact disposed at the bottom of the other 25 of the two sleeves of the internal double sleeve 12 intended to receive the outlet fitting 23 of the cartridge.

In this connection, an internal lip 27 cooperating with the external wall of the fitting, 23 of the cartridge is formed on the internal wall 26 of the sleeve 25 close to the opening of the sleeve and its bevelled rim 31 in order to perfect the seal.

The slide 13 with its partition 22 is made of rigid material, e.g. a polypropylene. This rigid transverse partition 22 thus serves as a support for one of the fittings in this case the outlet fitting 23 of the cartridge 20. When the fitting 23 of the cartridge is engaged in the sleeve 25, there is no risk that it will pierce the flexible partition 14 as the rigid partition 22 is inserted between the flexible partition 14 and the fitting 23.

The rigid transverse partition 22 is provided with orifices 28 for the passage of the material of the double sleeve 12, in this case injection-moulded material.

The central bore 29 extending through the flexible transverse partition 14, the bore 35 which forms a continuation thereof and extends through the rigid transverse partition 22 and the bore formed by the internal wall 26 of the sleeve 25 which forms a continuation of the bore 35 form the duct for the passage of gas of the sealing connector 11.

In the example of the connector shown in FIGS. 1-3, not only is the rigid transverse partition 22 integral with the slide 13, but the assembly formed by this partition and the slide is formed in one piece, in this case by injection moulding. In addition, it will be noted that the two transverse partitions, namely the flexible partition 14 and the rigid partition 22, are contiguous.

The connection of inlet fitting of the solenoid valve 30 and the outlet fitting 23 of the gas cartridge 20 will now be described.

In order to mount the adapter 1 on the cartridge 20, the fastening skirt 5 is inserted inside the edge 21 of the cartridge 20. The circumferential boss 6 is hooked and clipped on to the internal wall of the edge 21.

When the adapter 1 is fastened to the cartridge 20, the outlet fitting 23 of the cartridge 20 is guided by the bevelled rim 31 of the sleeve 25 until the edge 33 of the fitting 23 comes to bear against the rigid partition 22.

The adapter 1 is then slid on to the solenoid valve 30 and the connector 11 is slid on to the male inlet fitting of the solenoid valve, the fitting engaging in the sleeve 16 of the connector 11 until the spherical portion of the fitting is housed in the dish 17 of the sleeve 16 and therefore the adapter is hooked on to the fitting.

Finally, the connector 11 is mounted on the cartridge 20 and the solenoid valve 30 by a relative movement of translation of the three elements.

If, for some reason, it is desired to remove the cartridge 20 from its housing before it is empty, by virtue of the slide 13, the connector 11 will be retained in the adapter 1 and the outlet fitting 23 will return to its closing position prior to mounting.

Figure 4:
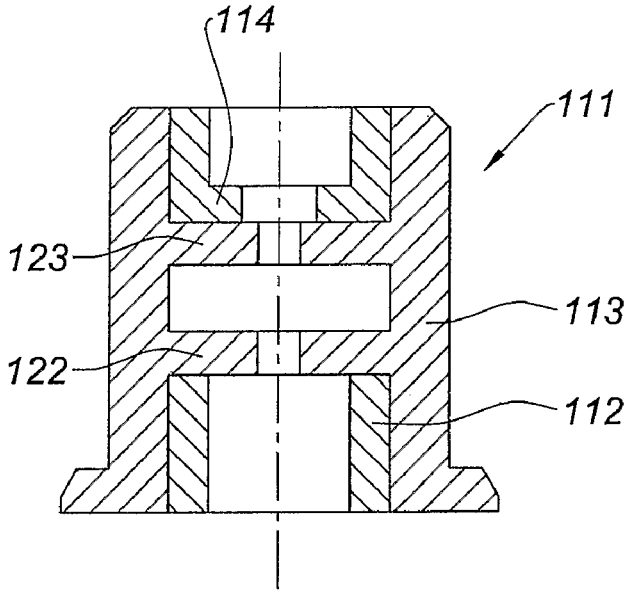
FIG. 4 is a diagrammatic axial section of a first variant embodiment of the connector of the invention.

The first variant embodiment of the connector of FIG. 4, shown in very diagrammatic form, also includes a tubular slide 113 in which a double sleeve 112 is housed, with its flexible transverse partition 114 for dimensional adjustment. The connector 111 of this FIG. 4 is distinguished from that of FIGS. 1-3 in that the slide includes two rigid transverse partitions, one 122 serving as a support for the outlet fitting of the cartridge and the other 123, adjacent to the flexible transverse partition 114, to reinforce it. The two rigid transverse partitions 122, 123 are disposed at a short distance from one another.

Figure 5:
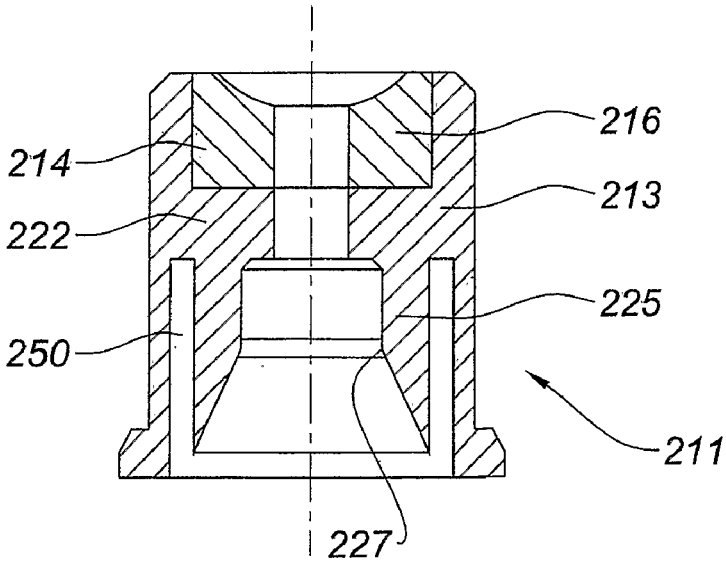
FIG. 5 is a diagrammatic axial section of a second variant embodiment of the connector of the invention.

In the second variant embodiment of FIG. 5, the connector 211 includes two sleeves 216 and 225 for receiving the fittings, but not formed in one piece. One, namely the connector 216, is made of flexible material in order to receive the inlet fitting of the transmission member (solenoid valve) 30. The other, namely the connector 225, is made of a rigid material in order to receive the outlet fitting 23 of the cartridge. The second rigid sleeve 225 has the particular feature that it is formed in one piece with the external slide 213. It extends inside the latter with, in this case, annular play 250. As for the rest, the flexible annular partition 214 for dimensional adjustment is once again situated at the bottom of the first flexible sleeve 216 and the rigid transverse annular partition 222 intended to serve as a support for the outlet fitting 23 of the cartridge is situated at the bottom of the second rigid sleeve 225.

As a result of the rigidity of the sleeve 225, sealing with the outlet fitting 23 of the cartridge is ensured essentially by an internal lip 227 cooperating with the external wall of the fitting.

In the embodiment of FIG. 5, the connector is obtained by simple assembly, with no need for overmoulding, as in the case of the connectors of the other figures.

The invention claimed is:

1. A sealing connector for ensuring sealing between a gas cartridge and a transmission member for filling a combustion chamber of a gas fastening device with gas, the gas cartridge having an outlet fitting, the transmission member having an inlet fitting, said sealing connector comprises:

a tubular external slide; and a first internal sealing sleeve and a second internal sealing sleeve for receiving the inlet fitting of the transmission member and the outlet fitting of the cartridge, respectively;

wherein the first internal sealing sleeve has a first opening and a flexible transverse annular partition for dimensional adjustment at a bottom of the first sleeve;

the second internal sealing sleeve has a second opening; and a rigid transverse annular partition is at a bottom of the second sleeve to serve as a support for the outlet fitting;

said flexible transverse annular partition has a first surface and a second surface, the second surface opposite to the first surface and contacting the rigid transverse annular partition over a length that is greater than a length of the first surface;

the rigid transverse annular partition is integral in one piece with the slide;

the flexible transverse annular partition and the rigid transverse annular partition are contiguous;

the first internal sealing sleeve and the second internal sealing sleeve are joined together to form a double internal sealing sleeve;

the double sleeve made of flexible material is an injection-moulded part and the rigid transverse annular partition is provided with orifices for the passage of the injection-moulded material of the double sleeve.

2. Assembly for connection to a transmission member for filling a combustion chamber of a gas fastening device with gas, said assembly comprising:

a gas cartridge, an adapter, and a connector of claim 1 mounted in the adapter for providing sealing between the transmission member and the cartridge.

* * * * *